US008157014B2

(12) United States Patent
Hariharan et al.

(10) Patent No.: US 8,157,014 B2
(45) Date of Patent: Apr. 17, 2012

(54) SUBSEA SOLIDS PROCESSING APPARATUSES AND METHODS

(75) Inventors: Peringandoor Raman Hariharan, Houston, TX (US); Robert Arnold Judge, Houston, TX (US); Dat Nguyen, Houston, TX (US); Greg Bailey, Kingwood, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 370 days.

(21) Appl. No.: 12/334,006

(22) Filed: Dec. 12, 2008

(65) Prior Publication Data

US 2010/0147593 A1 Jun. 17, 2010

(51) Int. Cl.
*E21B 43/36* (2006.01)
*E21B 7/12* (2006.01)
*B02C 23/00* (2006.01)

(52) U.S. Cl. ..... 166/357; 166/358; 241/236; 241/46.06

(58) Field of Classification Search ..... 166/357, 166/358, 267; 241/236, 46.06
See application file for complete search history.

(56) References Cited

U.S. PATENT DOCUMENTS 1,637,965 A * 8/1927 Schmidt et al. ..... 241/60
2,472,725 A * 6/1949 Rundle ..... 241/157
4,017,032 A * 4/1977 Dyas ..... 241/15
4,060,140 A * 11/1977 Barrington ..... 175/7
4,186,888 A 2/1980 Galanty
4,373,592 A 2/1983 Dellinger et al.
4,491,278 A 1/1985 Galanty
4,495,456 A * 1/1985 Vercillo et al. ..... 318/755
5,074,996 A 12/1991 Galanty et al.
5,302,082 A 4/1994 Gilbert
5,400,977 A 3/1995 Hayles, Jr.
5,829,692 A 11/1998 Walters
5,934,580 A * 8/1999 Maier et al. ..... 241/100
5,947,396 A 9/1999 Pierce
6,102,673 A * 8/2000 Mott et al. ..... 417/392
6,202,949 B1 3/2001 Hayles, Jr.
6,321,860 B1 * 11/2001 Reddoch ..... 175/206
6,527,054 B1 * 3/2003 Fincher et al. ..... 166/357
2001/0054658 A1 * 12/2001 Nakagomi ..... 241/236

OTHER PUBLICATIONS

Dick, M.A., Heinz, T.J., Svoboda, C.F., Aston, M., "Optimizing the Selection of Bridging Particles for Reservoir Drilling Fluids", SPE International Symposium on Formation Damage, Lafayette, LA., USA, Feb. 23-24, 2000.

(Continued)

*Primary Examiner* — David Bagnell
*Assistant Examiner* — Catherine Loikith
(74) *Attorney, Agent, or Firm* — Bracewell & Giuliani LLP

(57) ABSTRACT

In a dual-gradient drilling apparatus, a subsea solids processing unit includes a housing, a solids processing mechanism disposed in the housing between a drilling mud inlet and a drilling mud outlet, and a flushing mechanism configured to flush the solids processing mechanism with a flushing fluid. A subsea solids processing unit may be controlled by rotating the solids processing mechanism in a forward direction and increasing a drive torque when a measured speed of the solids processing mechanism is below a desired rotation speed. The desired rotation speed may be decreased when a measured torque exceeds a selected maximum and a rotation direction of the solids processing mechanism may be reversed when the measured speed falls below a selected minimum.

17 Claims, 8 Drawing Sheets

OTHER PUBLICATIONS

Van Oort, E., Hale, A.H., Mody, F.K. and Roy, S., "Critical Parameters in Modelling the Chemical Aspects of Borehold Stability in Shales and in Designing Improved Water-Based Shale Drilling Fluids", SPE Annual Technical Conference and Exhibition, New Orleans, LA, USA, Sep. 25-28, 1994.

Hale, A.H., Albrecht, M.S., Roy, S., Dzialowski, A. and Mody, F.K., "Preliminary Report on Effectiveness of Different Lubricants on Wear and Friction Coefficient Using Shale Medium", SPE/IADC Drilling Conference, Amsterdam, Feb. 28-Mar. 2, 1995 pp. 171-186.

"Operation and Maintenance Manual" (Rev. 0), TM2300 Taskmaster, Sub-Sea Crusher (Document OM00160A), Franklin Miller, Inc., Livingston, NJ, Apr. 24, 2001.

Bourgoyne, A.T., Chenevert, M.E., Millheim, K.K. and Young, F.S., "Applied Drilling Engineering", SPE Textbook Series, vol. 2, Society of Petroleum Engineers, Richardson, TX 1986 Chapter 4, pp. 156-157.

Okrajni, S. and Azar, J.J., "The Effects of Mud Rheology on Annular Hole Cleaning in Directional Wells", (SPE 14178), Society of Petroleum Engineers Drilling Engineering (SPEDE) Journal, Aug. 1986 pp. 297-308.

Azar, J.J. and Becker, T.E., Thomas, R. P., "Drillpipe Eccentricity Effect on Drilled Cuttings Behavior in Vertical Wellbores", (SPE 9701), Journal of Petroleum Technology, Sep. 1982.

Ledgerwood III, L.W., and Salisbury, D.P., "Bit Balling and Wellbore Instability of Downhole Shales", (SPE 22578), SPE Annual Technical Conference and Exhibition, Dallas, TX, USA 1991.

PCT/US2009/063104, Search Report and Written Opinion, May 31, 2010.

* cited by examiner

SUBSEA SOLIDS PROCESSING APPARATUSES AND METHODS

BACKGROUND

1. Field of the Disclosure

Embodiments disclosed herein relate generally to apparatuses and methods related to the handling and processing of drilled solids from subsea wells. More particularly, embodiments disclosed herein relate to apparatuses and methods to promote proper operation of subsea pumps so as to minimize plugging process/mud return lines due to drill cuttings entrained therein. More particularly still, embodiments disclosed herein relate to methods and apparatuses to ensure continuous circulation of a wellbore by limiting particle size and reducing the number of larger particles.

2. Background Art

In off-shore drilling operations, drill cuttings that are generated in a well are pumped up from the drill bit to the surface utilizing rig mud pumps on a floating drilling vessel. The drill cuttings are carried back to the surface in a fluid medium called the drilling fluid or drilling mud.

Those skilled in the art and familiar with drilling technology will appreciate that the solids and cuttings generated during a drilling operation may span a wide spectrum of types, shapes and sizes. They range from the very fine clays (e.g., 0.2-2.0 μm), to silt, sand, shale, limestone, claystone, sandstone, cement, and metal shavings generated during milling operations. Further, solids, such as cavings as well as sloughing shale from the well, may be generated, the sizes of which may vary anywhere from small pieces, two to five centimeters long, up to twenty-five centimeters in larger dimensions.

Along with the varying sizes of drill cuttings and solids, in certain areas in the world where the drilling operations are carried out (for example, in the Gulf of Mexico), the clay formations may be relatively younger and highly reactive. The clay formations may have a tendency to form a highly sticky mass of solids known in the drilling industry as "gumbo." These types of hydrated clay formations may be difficult to drill because they have a tendency to stick to the drill bits and have been known to plug pipelines and flow lines, causing a variety of drilling problems. Further, these clay formations are commonly encountered in drilling operations; about 60-70% of all formations drilled are clays and shales.

Once the drill cuttings are generated at the drill bit, the cuttings travel upward through an annular space, first between the open borehole being drilled and a drill string, and then between the installed casing and the drill string, until they reach the sea floor. From the sea floor they may continue to the surface in the same drilling fluid medium through the annular space between the drill string and a wellhead, a blowout preventer, and a marine riser. At the surface, just below the rotary table, the drilling fluids along with various solids and/or the drill cuttings, may be diverted to a shaker that separates the drill cuttings from the drilling fluid. After passing through the shakers, the drilling fluid may circulate through further solids-processing equipment, for example, de-sanders and/or de-silters to separate sand and silt therefrom.

In drilling operations performed at large depths, the drill cuttings may be returned to the surface in a dual-gradient drilling operation. In a dual-gradient drilling operation, the returning drilling fluid does not enter the annulus of the marine riser extending from the sea floor to the drilling rig. Instead, it is diverted away from the wellbore at the sea floor by a rotating seal assembly, so that the marine riser is maintained full of seawater. The diverted drilling fluid along with the drill cuttings may then enter a pumping apparatus, for example, a mudlift pump. The solids laden mud entering pump chambers of the mudlift pump may be compressed and pumped up to about 265-275 liters (70-75 gallons) per stroke into the mud discharge piping and may maintain a flow rate up to about 3420 liters per minute (900 gpm). Thus, the mud discharge piping runs from the sea floor to the surface, thereby transporting the drill cuttings from the sea floor to the surface. In certain applications, the drill cuttings may be transported to a floating vessel for disposal.

Cuttings contained in drilling fluids passing through various components in a dual-gradient drilling operation raise significant concerns as compared to traditional subsea operations. In conventional subsea drilling operations, the drill cuttings are carried through the annulus of the riser. Common riser sizes used today may include sizes of about 54 cm (21 in) in diameter. Assuming a 6⅝ inch size drill pipe, there may be an annular space, or radial gap between the riser and the drill pipe of about 17 cm (7 in) through which solids and drill cuttings may pass. Furthermore, larger sizes of solids are common in subsea drilling operations from caving, sloughing, broken cement plugs, and coiled masses of metal shavings known as "bird nests" resulting from metal milling operations.

Available literature discusses that in order for an opening to start plugging with solids, a minimum diameter of the solid particles should be at least equal to or greater than one-third a diameter of the hole through which the solid particles pass. This is the prerequisite to initiate bridging and to start plugging. Using this criteria, the minimum diameter of solids or the size of solids in the largest dimension that may easily pass through the present annulus may be about 6 cm (2.3 in). While this is a relatively large cutting size, a riser used in a conventional drilling operation described above would be able to pass such cuttings.

However, in a dual-gradient drilling operation, the drill cuttings and solids must additionally pass through mudlift equipment before returning to the drilling vessel.

Mudlift pumps may have inlet and outlet lines too small to pass larger cuttings and solids therethrough. For example, inlet lines of a mudlift pump may have a diameter of about 15 cm (6 in), while outlet lines may have a diameter of about 11.5 cm (4.5 in).

Additionally, internal chambers of the mudlift equipment may not be large enough to accommodate some larger solids. Based on the above criteria, and so as not to initiate bridging and cause plugging of the return lines or the mudlift pump chambers, the drill cuttings would have to be no larger than about 4 cm (1.5 in) along the largest dimension.

The above points out the importance of treating and handling solids in any type of drilling operation. Even in conventional drilling operations, with no hindrances posed in the return drilling fluid stream, the solids may have a tendency to cause severe problems. In dual-gradient drilling, these problems may be magnified with the added components through which the drilling fluid must pass. Previously, U.S. Pat. No. 6,102,673, issued to Mott, and incorporated fully herein by reference, discloses a dual-gradient drilling concept and mentions the utilization of a solids control system to restrict the size of the solids entering the system.

Additionally, solids returned to the surface and separated at the shale shaker may be important from a geological standpoint. The solids represent the various types of rock strata and geological formations that the drill bit has cut and drilled through. From the solids that are separated at the shale shaker, small samples may be examined at regular intervals by a geologist for study and analysis. This may be especially true in the case of an exploratory well where regular sample collection, tagging, study, and analysis are of paramount importance for the detection of hydrocarbons as well as for fossil study and other tasks that are deemed to be of geological importance. Those skilled in the art would appreciate the importance of preserving the integrity of the materials from the drilled formation as well as the need for its geological study.

Accordingly, there exists a need for a system to prevent a situation that may cause plugging and to facilitate the entry of the solids-laden drilling fluid into the pumping apparatus and through the return lines. Further, a system of bringing the drilled solids samples back to the surface with as little damage and as fast as possible would be well received in related industries.

SUMMARY OF THE DISCLOSURE

In one aspect, embodiments disclosed herein relate to a subsea solids processing unit, including housing comprising a drilling mud inlet and a drilling mud outlet, a solids processing mechanism disposed in the housing between the drilling mud inlet and the drilling mud outlet, and a flushing mechanism configured to wash the solids processing mechanism with a flushing fluid. The solids processing mechanism may include a first shaft comprising a first plurality of cutters and configured to rotate about a first axis in a first direction, and a second shaft comprising a second plurality of cutters and configured to rotate about a second axis in a second direction, wherein the first plurality of cutters is configured to intermesh with the second plurality of cutters.

In another aspect, embodiments disclosed herein relate to a method to retrieve drilling mud containing entrained solids from a subsea well to a surface facility including flowing the drilling mud containing entrained solids from the subsea well into an inlet of a subsea solids processing unit, breaking up a portion of the entrained solids from the subsea well exceeding a specified size with intermeshed cutters of the subsea solids processing unit, discharging the drilling mud and the broken-up entrained solids from the outlet of the subsea solids processing unit, and pumping a solution comprising the discharged drilling mud and the broken-up entrained solids to the surface facility.

In another aspect, embodiments disclosed herein relate to a method to control a subsea solids processing unit comprising rotating a solids processing mechanism in a forward direction at a desired rotation speed with a drive mechanism, reducing drilled solids entrained in a drilling mud with the solids processing mechanism when rotated in the forward direction, measuring a speed of the solids processing mechanism, measuring a drive torque of the drive mechanism with a drive torque sensor, increasing the drive torque when the measured speed of the solids processing mechanism is below the desired rotation speed, decreasing the desired rotation speed when the measured drive torque exceeds a selected maximum, and reversing the rotation direction of the solids processing mechanism when the measured speed falls below a selected minimum.

Other aspects and advantages of the invention will be apparent from the following description and the appended claims.

BRIEF DESCRIPTION OF DRAWINGS

Features of the present disclosure will become more apparent from the following description in conjunction with the accompanying drawings.

DETAILED DESCRIPTION

As described above, mudlift pumps may have relatively small pump chambers and fluid inlets, and therefore may require drill cuttings in the drilling fluid to be reduced in size before entry into the pump to prevent clogging. Embodiments of the present disclosure are configured to prevent circumstances that may cause plugging of lines and to facilitate the entry of the drilled solids-laden mud into a mud-lift pump chamber.

Figure 1:
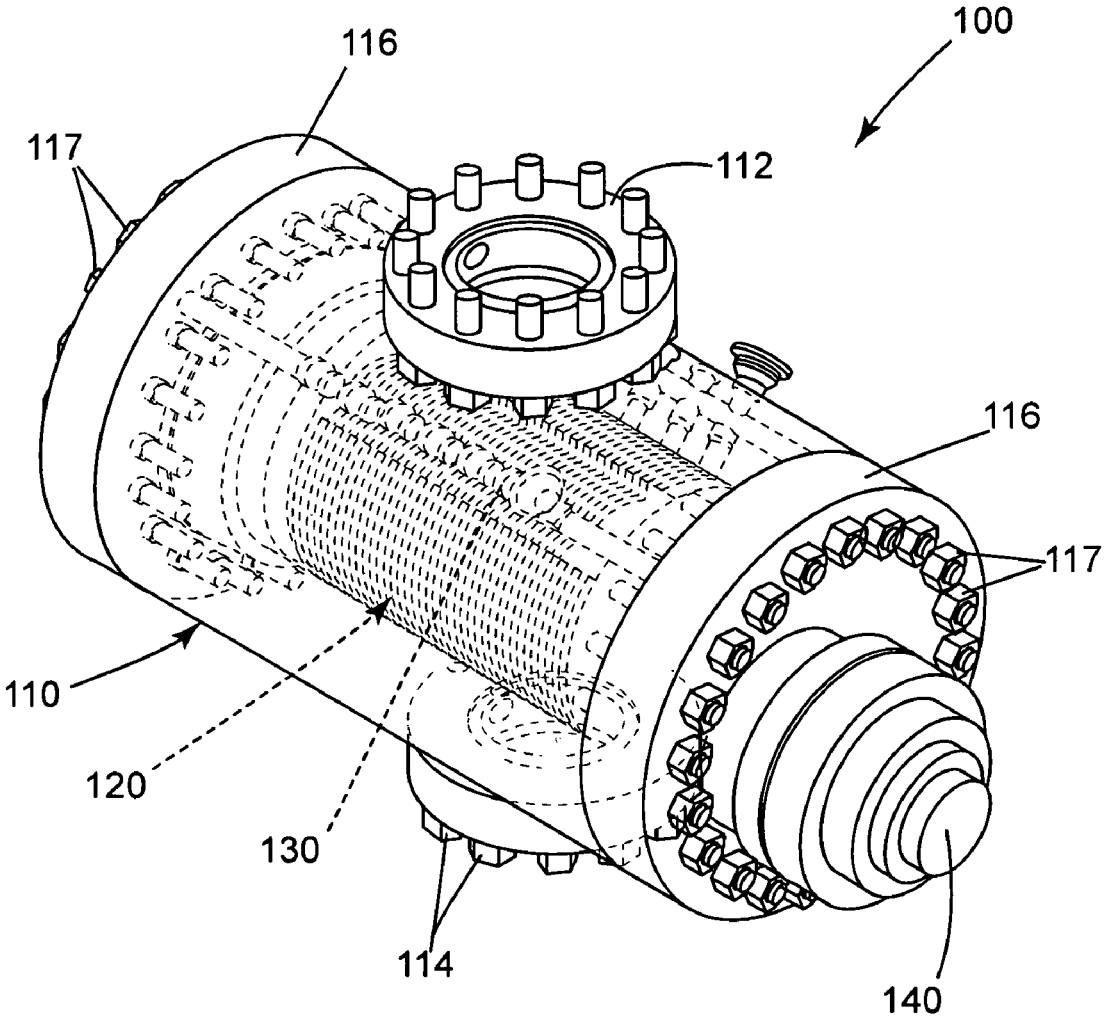
FIG. 1 is a perspective assembly view of a subsea solids processing unit in accordance with embodiments of the present disclosure.

Referring initially to FIG. 1, an assembly view of a subsea solids processing unit ("SPU") 100 is shown in accordance with embodiments of the present disclosure. Solids processing unit 100 includes a cylindrical main housing 110 having a flanged fluid entry port 112 for fluid entry at the top and another flanged port 114 for fluid discharge at the bottom. Main housing 110 further includes circular cover plates 116 attached on both ends with retaining bolts 117. However, it should be understood that cover plates 116 may be secured to main housing 110 by any means known to a person skilled in the art, including, but not limited to, screws, rivets, and studs.

In selecting fasteners to attach cover plates 116 to main housing 110, stresses may be determined considering all loading on the SPU 100, including pressure acting over the seal area, gasket loads, and any additive mechanical loads as understood by those skilled in the art. A maximum tensile stress may be determined considering initial make-up loads of the fasteners, working conditions of the SPU 100, and hydrostatic test conditions. Stresses on the fasteners, based on a minimum cross sectional area, may not exceed the limits as described in API Specification 16A and understood by those skilled in the art.

Main housing 110 of SPU 100 further includes a solids processing mechanism 120 disposed therein and described in more detail below. Solids processing mechanism 120 may be powered by a drive mechanism 140 attached on an end of main housing 110. Drive mechanism 140 may include a variable speed hydraulic motor driven by a variable discharge hydraulic pump and may be configured to selectively run in either a forward or a reverse direction. In alternative embodiments, electric or other motor types as would be known to one of ordinary skill may be used for drive mechanism 140. However, it may be advantageous to use a hydraulic motor for drive mechanism 140 as hydraulic motors may provide decreased shock loads and vibrations to the components of the SPU 100 during operation.

Figure 2:
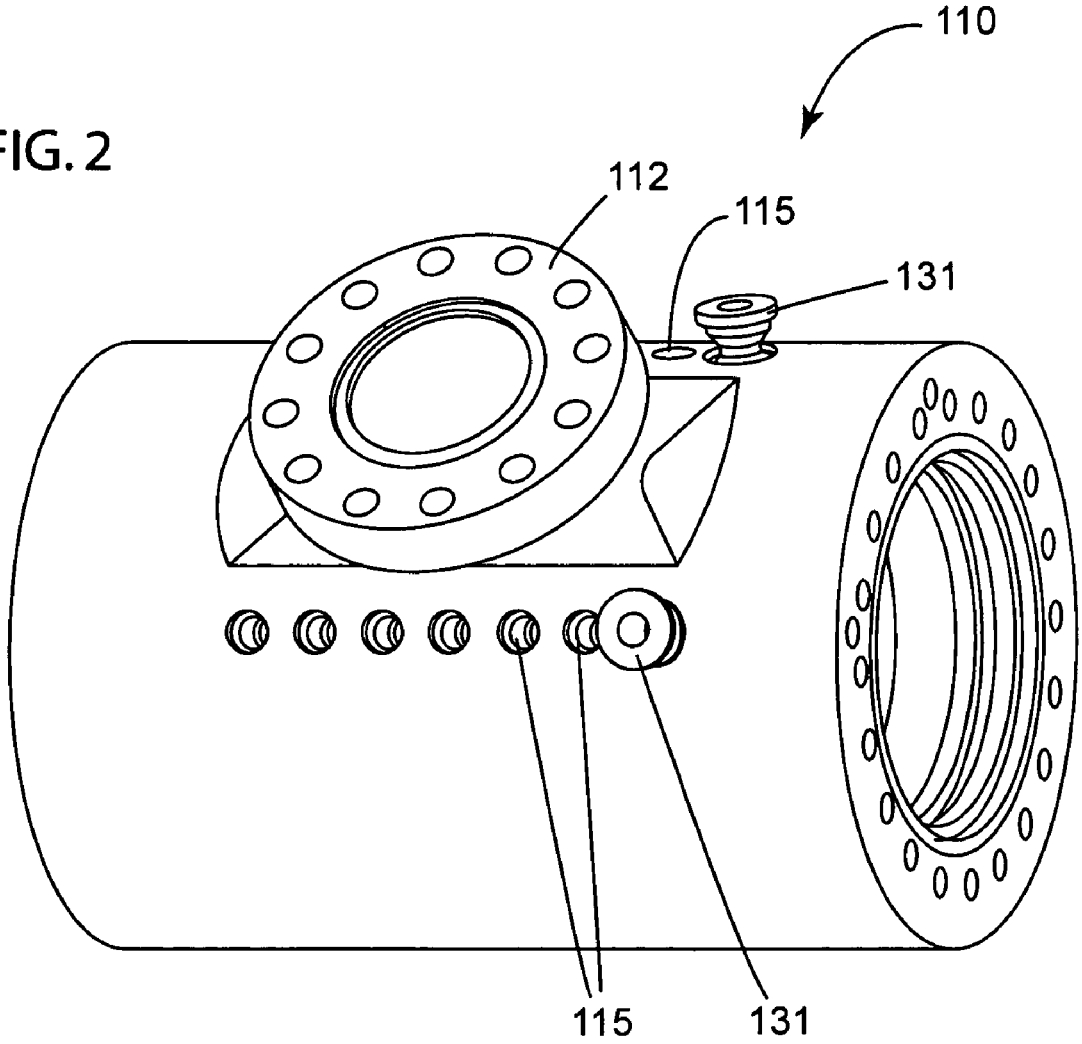
FIG. 2 is a component view of a main housing of the subsea solids processing unit in accordance with embodiments of the present disclosure.

Referring briefly to FIG. 2, a component view further detailing main housing 110 in accordance with embodiments of the present disclosure is shown. As shown, main housing 110 may be configured as a cylindrical shell, although one of ordinary skill will appreciate that main housing 110 may also be manufactured in alternative geometries. As shown in FIG. 2, main housing 110 includes multiple rows of ports (i.e. threaded holes) 115 for the attachment of nozzles 131 of a flushing mechanism (130 of FIG. 1, described in further detail below). Furthermore, in select embodiments, main housing 110 may be constructed to maintain a working pressure rating of about 5000 psi and may also conform to ASME Section VIII, Division 2 of the Boiler and Pressure Vessel Code as would be understood by those having ordinary skill in the art.

Figure 3A:
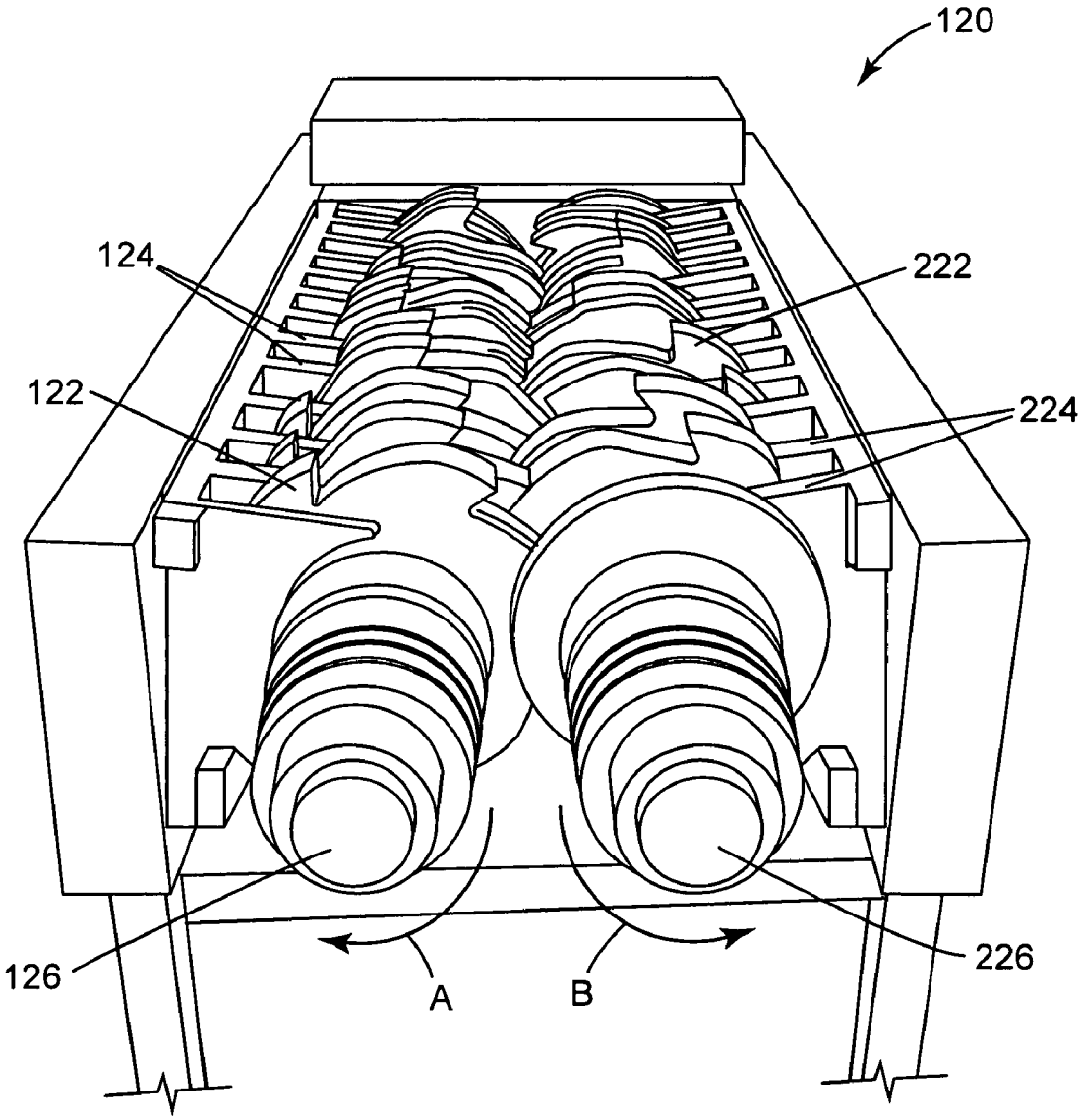
FIG. 3A is an assembly view of a solids processing mechanism in accordance with embodiments of the present disclosure.
Figure 3B:
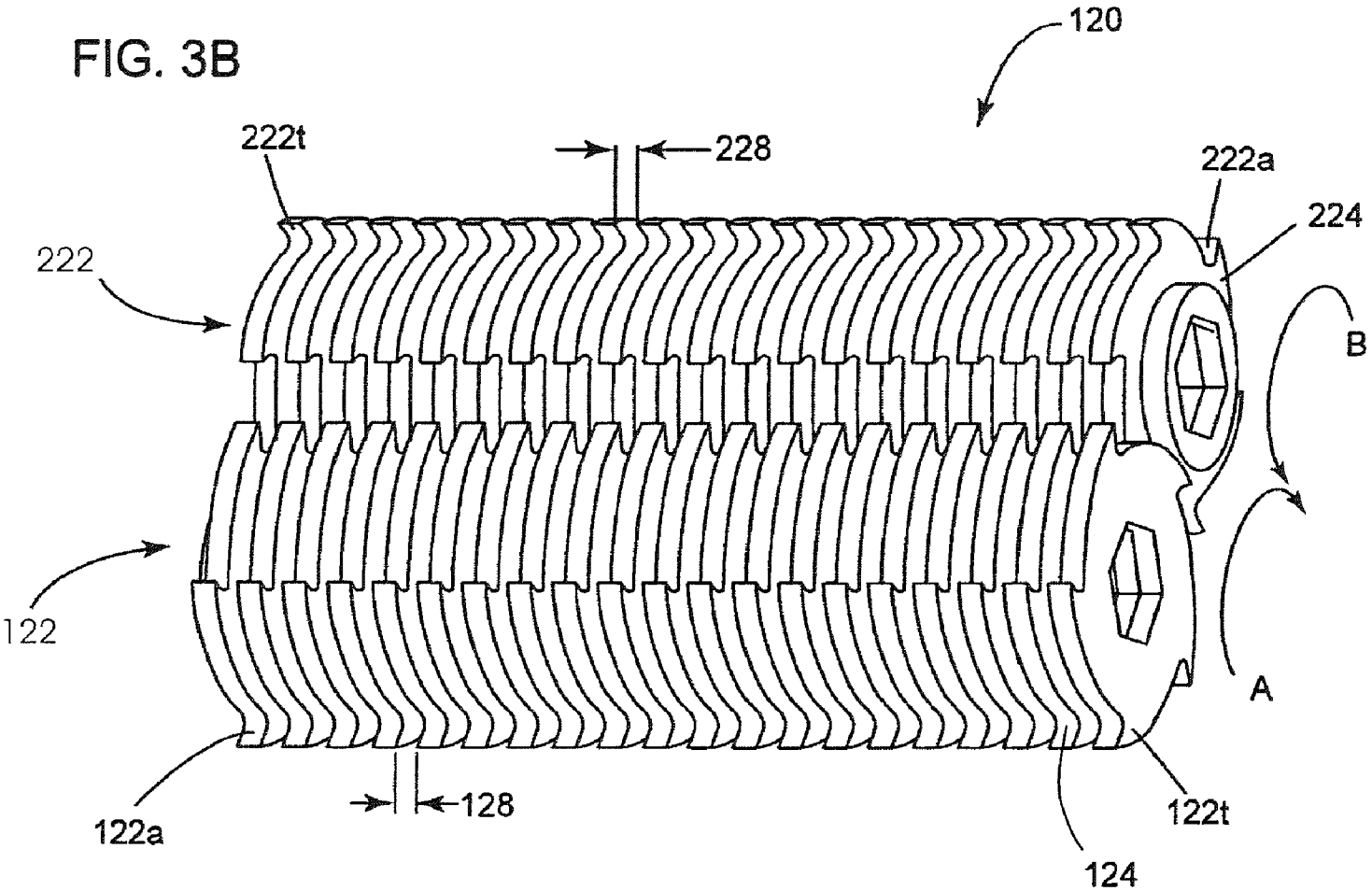
FIG. 3B is an assembly view showing a meshing arrangement between cutters of the solids processing mechanism of FIG. 3A.
Figure 3C:
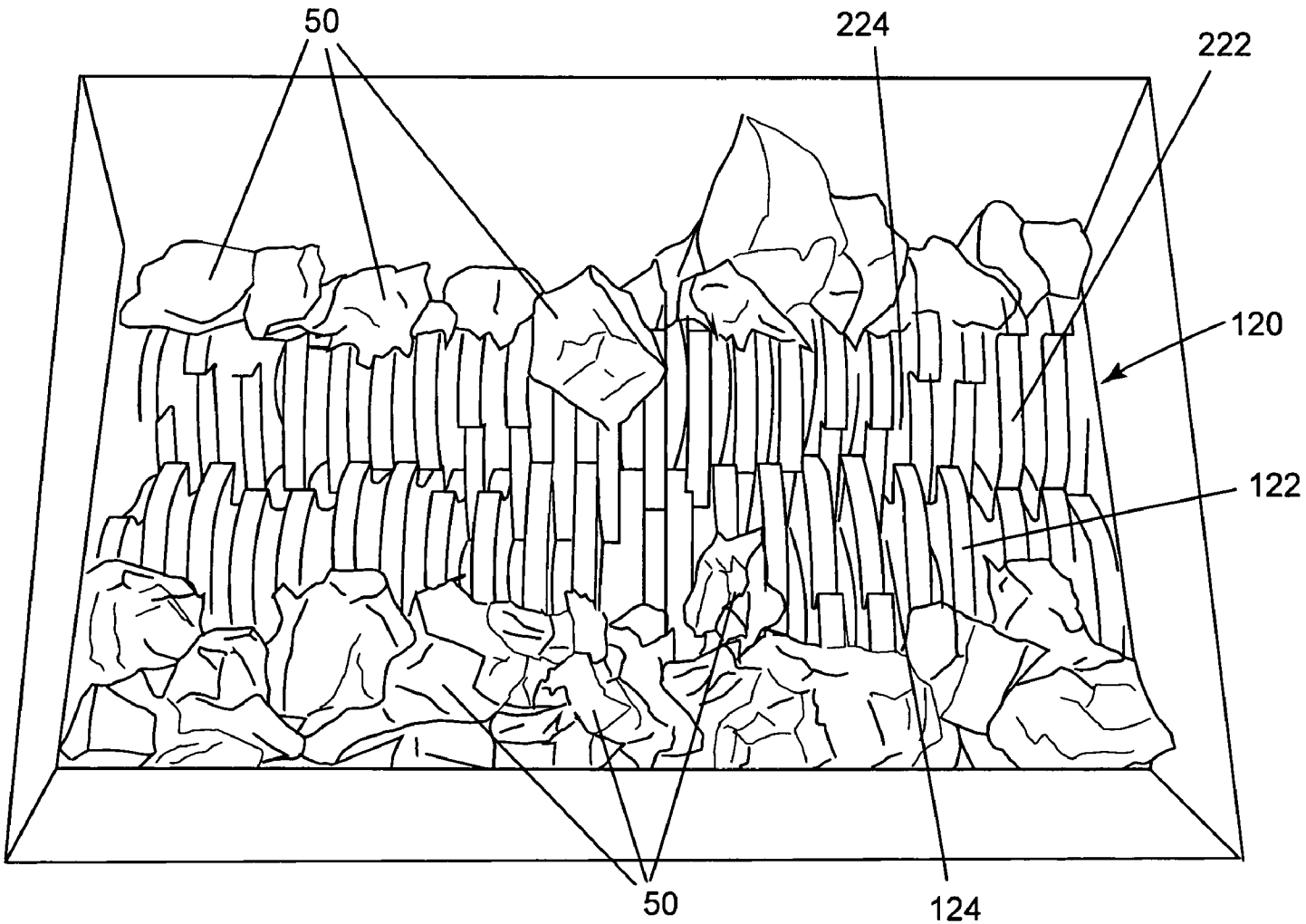
FIG. 3C is an assembly view showing drill cuttings in the solids processing mechanism of FIG. 3A.

Referring now to FIGS. 3A-3C, the various components and configuration of solids processing mechanism 120 will be described. Referring specifically to FIG. 3A, an assembly view of solids processing mechanism 120, in accordance with embodiments of the present disclosure, is shown. Solids processing mechanism 120 includes a first shaft 126 configured to rotate in a first direction as shown by direction arrow A, and a second shaft 226 configured to rotate in an opposite direction as shown by direction arrow B. Shafts 126 and 226 each carry a set of cutters 122 and 222 that may be generally co-axially positioned with respect to the shaft and are configured to rotate with shafts 126 and 226. While solids processing mechanism 120 is depicted in FIG. 3A as having two shafts 126, 226, solids processing mechanisms including additional shafts of cutters should not be considered outside the scope of the present disclosure.

Solids processing mechanism 120 may also include a plurality of spacers or combing fingers 124 and 224 located proximally to shafts 126 and 226 and spaced between the cutters 122, 222 along axes of shafts 126, 226. Although spacers 124, 224 are shown as extensions from the frame of solids processing mechanism 120 that extend toward shafts 126, 226, it should be understood that shafts 126, 226 may also include spacing structures (not shown) mounted and spaced axially thereupon between adjacent cutters 122, 222 and axially aligned with spacers 124, 224. Such spacing structures may, in addition to providing spacing functions, facilitate the installation of spacers 124, 224 upon shafts 126, 226 as well as facilitate the installation of shafts 126, 226 within solids processing mechanism 120.

Referring still to FIG. 3A, both shafts 126 and 226 may be supported on the their respective ends by a bearing (not shown) and a pressure seal cartridge (not shown), either of which may be mounted in a shaft housing (not shown) as would be understood by a person having ordinary skill. Further, the shaft housings for shafts 126 and 226 may be integrally connected by a side frame (not shown) on both ends, thereby forming a single-unit solids processing mechanism 120. In this manner, solids processing mechanism 120 may be configured as a single unit or cartridge which is removable apart from main housing 110 of solids processing unit (100 of FIG. 1).

Referring now to FIG. 3B, an arrangement of cutters 122 and 222 of solids processing mechanism 120 in two columns generally corresponding to shafts 126 and 226 of FIG. 3A will be described. As shown, depending on the length of shafts (126, 226 of FIG. 3A) and the widths of cutters 122, 222 (and corresponding spacers 124, 224 of FIG. 3A), the number of cutters 122, 222 on each shaft 126, 226 may vary. Therefore, as shown in FIG. 3B, cutters 122 include an array of cutters 122 extending from first cutter 122*a* to last cutter 122*t* separated by a plurality of axial gaps 128, and cutters 222 include an array of cutters 232 extending from first cutter 222*a* to last cutter 222*t* separated by a plurality of axial gaps 228.

Referring collectively to FIGS. 3A and 3B, cutters 122 and 222, and spacers 124 and 224, are shown configured along an axial length of the shafts 126 and 226 in such a way as to form an intermeshing arrangement between cutters 122 and 222. To achieve such an intermeshing arrangement, cutters 122, 222 and spacers 124, 224 may be configured such that each cutter 122 on shaft 126 is axially aligned with a spacer 224 on shaft 226 and each cutter 222 on shaft 226 is axially aligned with a spacer 124 on shaft 126. In this manner, solids processing mechanism 120 may be configured to have a desirable clearance between the cutters on opposite shafts to provide a high degree of shearing action to the drill cuttings passing through the SPU 100.

As would be understood by one having ordinary skill in the art, axial gaps 128, 228 may have a width (in the axial direction of shafts 126, 226) that is either about the same width as spacers 124, 224 or slightly wider than spacers 124, 224 by a specified clearance. The amount of specified clearance may be a design consideration for solids processing mechanism 120 that may selected as a function of drilling fluid viscosity, drilling fluid composition, desired cuttings size, anticipated cuttings material, anticipated operating temperature, the material properties of components used in the solids processing mechanism 120, the manufacturing tolerances of the components used in the solids processing mechanism 120, any other property that may affect the selected gap, or a combination thereof. While axial gaps 128, 228 (i.e., the spaces occupied by spacers 124, 224 along axes of shafts 126, 226) and cutters 122, 222 are depicted as having a constant width in the direction along the axes of shafts 126, 226, it should be understood that variable widths for cutters 122, 222 and gaps 228 may be used.

Referring now to FIG. 3C, an overhead view of solids processing mechanism 120 with drilled solids 50 in position to be processed in accordance with embodiments of the present disclosure is shown. The intermeshing arrangement between cutters 122, 222 and spacers 124, 224 of opposite shafts (126 and 226 of FIG. 3A) is shown with minimal clearances between adjacent cutters 122 and 222, as previously described. This configuration may prevent any larger drilled solids 50 from passing through the solids processing mechanism 120 without being reduced in size and may apply higher shearing forces to drilled solids 50.

Figure 4:
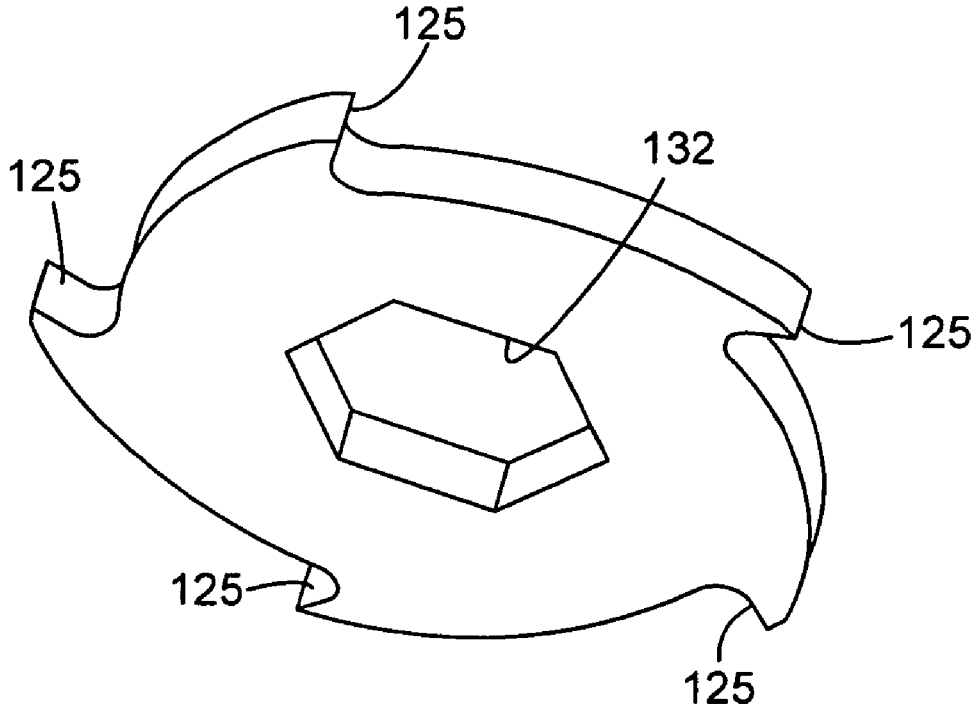
FIG. 4 is a component view of a cutter in accordance with embodiments of the present disclosure.

Referring briefly to FIG. 4, a component view of a cutter 122 (or 222) in accordance with embodiments of the present disclosure is shown. As shown, cutter 122 may include multiple cutting edges 125 circumferentially arranged about an outer perimeter of cutter 122 defined by an axis of shaft 126 or 226 (of FIG. 3A) extending therethrough. As cutters 122 rotate on shafts 126 and 226 in opposite directions, (i.e., as opposite facing cutting edges 125 on axially adjacent cutters 122 and 222 approach each other), they provide a crushing and "grinding" action on the drilled solids, thereby reducing the solids in size. A polygonal profile 132 at the center of cutter 122 prevents slippage between cutter 122 and shaft 126. Additionally, while cutter 122 is depicted in FIG. 4 as having five cutting edges 125, one of ordinary skill in the art will appreciate that fewer or additional cutting edges 125 may be used without departing from the present disclosure. Furthermore, as shown in the intermeshing arrangement of FIG. 3B, the radial height of cutting edges 125 and an outer diameter of spacers 124 and 224 may be set such that as cutters 122 and 222 are rotated about shaft 126 and 226, a selected distance between the cutting edges 125 and the outer diameter of spacers 124, 224 may be maintained. Those having ordinary skill will appreciate that by adjusting the selected distance, different sizes and geometries of processed solids may be achieved.

As would be understood by one having ordinary skill, it may be advantageous for all metallic materials used in solids processing unit 100, particularly internal components exposed to wellbore fluids, to meet the requirements of NACE Standard MR-01-75 for "sour" (i.e., high temperature and/or high sulfur) service. In addition to the metallic parts, all non-metallic parts as well as elastomeric parts may be exposed to salts, solvents, base oils, and other additives known in the art. Further, pressure-containing and controlling members, such as the main housing and cover plates, as well as the solids processing mechanism 120, may be manufactured from materials with chemical compositions that meet the requirements of API Specification 6A. Further still, the use of dissimilar metals and exposure to corrosive internal and external environments may require cathodic protection, coating, or other practices as known to those skilled in the art or as recommended in API Specification 17A.

Figure 5:
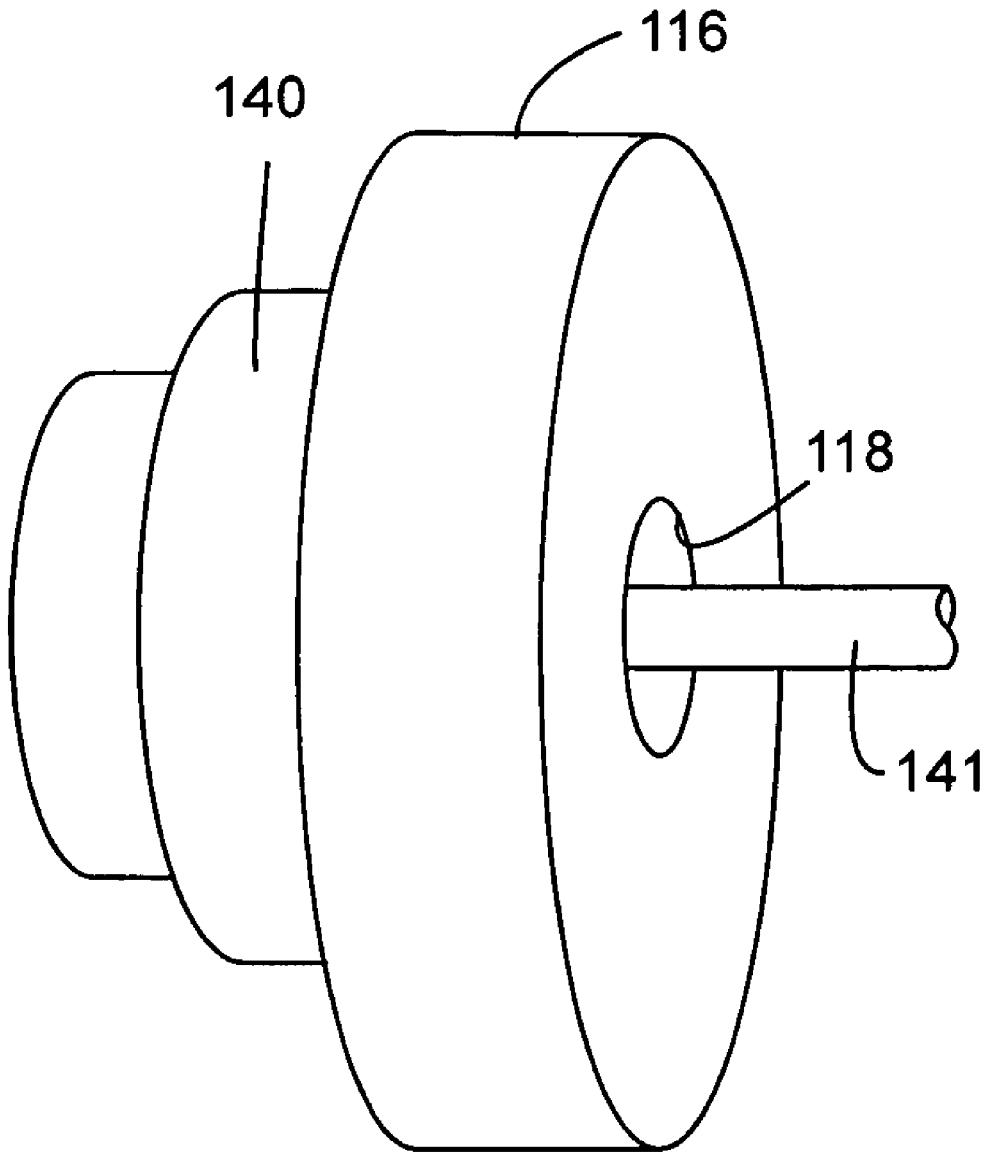
FIG. 5 is a component view of a cover plate in accordance with embodiments of the present disclosure.

Referring now to FIG. 5, in select embodiments, drive mechanism 140, attached to cover plate 116 of solids processing unit 100, may connect to an input shaft 141 of solids processing mechanism 120 (of FIGS. 1 and 3A-C) extending through an opening 118 in cover plate 116. As would be understood by one of ordinary skill, a sealing mechanism (e.g., o-rings, packers, etc.) may be located within or around opening 118 to isolate drive mechanism 140 on one side of cover plate 116 from solids processing mechanism 120 on the other side.

As described above, drive mechanism 140 may include a hydraulic motor, an electric motor, or any other type of power generation mechanism known to one having ordinary skill in the art. Similarly, drive mechanism 140 may be connected to input shaft 141 of solids processing mechanism 120 through any known mechanical means (e.g., a shaft key) known to those having ordinary skill. Additionally, shafts 126 and 226 (shown in FIGS. 3A-C) may be linked together by a gearing mechanism (not shown) at the end of the input shaft 141, wherein the gearing mechanism may be configured to allow the shafts 126, 226 to rotate in opposite directions.

Optionally, the gears of the aforementioned gearing mechanism may be contained within an elevated pressure lubrication system such that the pressure of the lubricating oil is higher than the pressure of the drill cuttings entering the solids processing mechanism 120. Having lubrication oil at a higher pressure allows the lubricating oil to escape to the solids processing mechanism 120 in the event of a leak, rather than allowing fluids from the solids processing mechanism 120 to escape to (and contaminate) the lubricating system.

Figure 6:
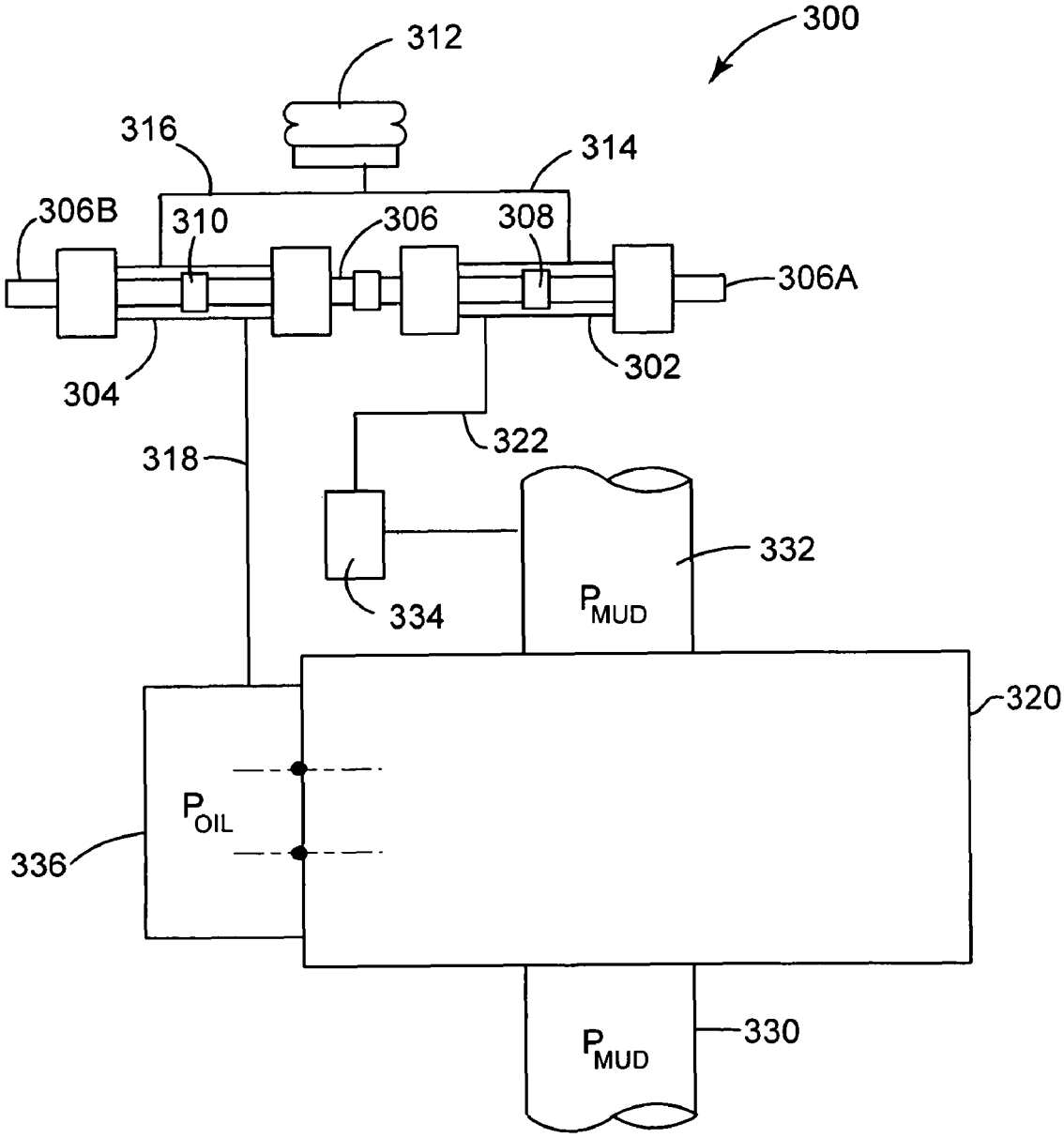
FIG. 6 is a schematic drawing of an elevated pressure lubrication system in accordance with embodiments of the present disclosure.

Referring briefly to FIG. 6, an example of an elevated pressure lubrication system 300 usable with a solids processing mechanism 320 in accordance with embodiments disclosed herein is shown schematically. Elevated pressure lubrication system 300 is shown having a first isolation cylinder 302 and a second isolation cylinder 304. A single piston shaft 306 connects pistons 308, 310 contained within the first and second isolation cylinders 302, 304. Alternatively, each isolation cylinder (302, 304) may be constructed having pistons (308, 310) on separate shafts if the two shafts (306A, 306B) are mechanically connected together. Furthermore, first isolation cylinder 302 (and therefore first piston 308) comprises a bore larger than second isolation cylinder 304 (and therefore second piston 310). An oil reservoir 312 connects an output line 314 of first isolation cylinder 302 to an input 316 of second isolation cylinder 304. Thus, a pressure applied to an input 322 of isolation cylinder 302 will be magnified by the ratio of cross-sectional area of pistons 308 and 310 at an output 318 of second isolation cylinder 304.

As such, a pressurized mud (PMUD) from an input 330 or an output 332 of a solids processing mechanism 320 may pressurize oil in input line 322 of first isolation cylinder 302 (in select embodiments, through a pressure isolator 334) to exert a force on piston 308. Force upon piston 308 displaces piston 308 to the right which, in turn, also displaces second piston 310 (coupled by shaft 306) to the right by the same amount. Thus, as piston 310 is larger than piston 308 by a known ratio, the pressure of the lubricating oil $P_{OIL}$ contained in lubricating oil supply 336 and thrust by larger, second piston 310 may be increased over the mud pressure $P_{MUD}$ by a factor equal to the ratio of the differential cro-sectional areas of the first 308 and the second 310 pistons. Thus $$P_{OIL} = P_{MUD} \times \frac{A_{310}}{A_{308}}; \quad \text{(Eq. 1)}$$

where $A_{310}$ is the cross-sectional area of second piston 310 and $A_{308}$ is the cross-sectional area of first piston 308.

Alternatively, in select embodiments, rather than including a gearing mechanism to link shafts 126, 226 as described above, two drive mechanisms, one for each shaft, may be attached and configured to independently rotate shafts 126, 226. While it may be desirable to rotate shafts 126, 226 in opposite directions and at equal speeds, there may be circumstances where it may be beneficial to rotate shafts 126, 226 in the same direction or at differing speeds.

Additionally, as shown in FIG. 1, solids processing unit 100 may further include a flushing mechanism 130 attached to an outer surface of main housing 110 configured to deliver a fluid to clean the cutters of solids processing mechanism 120. As shown in FIG. 1, flushing mechanism 130 may include rows of nozzles configured to spray fluid onto solids processing mechanism 120.

As mentioned earlier, the generated drilled cuttings may contain up to 60-70% of clay or shale type formations, which may exhibit a tendency to stick to metal and gradually build up. In solids processing mechanism 120, cuttings may build up on the cutters 122, 222 and the areas formed by the curvature of cutting edges of cutters 122, 222. This may lead to possible plugging or blockage of solids processing mechanism 120. As solids processing unit 100 may be installed in deep water on the sea floor, if solids processing mechanism 120 plugs, expensive retrieval and replacement operations may be required.

In order to prevent a plugged solids processing mechanism 120, flushing mechanism 130 may provide fluid flow at high velocity and/or pressure through multiple nozzles onto solids processing mechanism 120 during operation of solids processing unit 100. In select embodiments, flushing mechanism 130 may continuously clean or "flush" material off the cutters to prevent material build-up. The fluid stream exiting the nozzles of flushing mechanism 130 may have sufficient energy to flush or clean cutters 122 (in particular, edges 125) of solids processing mechanism 120 and remove stuck cuttings.

In select embodiments, the fluid used by flushing mechanism 130 to clean cutters 122, 222 may include "clean" drilling fluid (i.e., drilling fluid without entrained solids) supplied from the surface by the drilling rig or another vessel. In select embodiments, the fluid may be pumped down using a high head centrifugal pump or a triplex piston mud pump to attain sufficient cleaning velocities.

In select embodiments, the nozzles may be replaceable and may vary in diameter from 6 mm (¼ in) up to 26 cm (1 in). Sizing of the nozzles may be based on optimal or required flow rate, pump capabilities, drill cuttings material, and other requirements understood by those skilled in the art. Further, ports that are equivalent to nozzles may be used for flushing and may comprise a concentric hole drilled through a hex-headed bolt. Each bolt may be fitted directly to the threaded port 115 (of FIG. 2) so that flow through the bolt may be directed to the solids processing mechanism 120. Further, an o-ring or other seal mechanism may be used to seal between the surfaces of the head of the bolt and main housing 110 of solids processing unit 100.

In select embodiments, nozzle size may be selected based on at least two criteria. First, an optimal flow rate may be computed based on the level of flushing and cleaning desired, which may be calculated on the basis of maximizing the hydraulic horsepower available for cleaning the solids processing mechanism 120. Second, the size of the nozzles may be based on the pressure head developed by the hydrostatic column of mud above the nozzles combined with the head imparted by the high head centrifugal pump, such that the fluid expansion through the nozzles will have a minimal impact on the open formation through the annulus. Another possibility for ensuring that the pressure is not transmitted to the formation is through the use of a suitable fixed or variable choke in the line carrying the clean mud for flushing.

Referring to FIGS. 1-5, operation of solids processing unit 100 may be described as follows in accordance with select embodiments of the present disclosure. During the operation of the SPU 100, drilling mud containing drill cuttings (i.e., entrained solids) flows from a downhole location toward the mud-lift pumping equipment as described above. Solids processing unit 100 may be positioned just before the mud lift pumps to reduce the drill cuttings size and prevent plugging of the mud lift pumping equipment. The drill cuttings enter the SPU 100 through fluid entry port 112 on top of main housing 110. As the drill cuttings pass through SPU 100, cutters 122 and 222 of solids processing mechanism 120 rotate in the direction of arrows A and B, shown in FIGS. 3A and 3B, providing shearing, crushing, and grinding actions to reduce the size of the drill cuttings.

As the cuttings are crushed and ground into smaller pieces, they may be reduced to a small enough size to pass through solids processing mechanism 120 and exit SPU 100 through fluid discharge port 114 on the bottom of main housing 110. Other drill cuttings may be small enough to pass through SPU 100 without being reduced and may continue to the rig surface, providing unmodified geological samples for analysis.

For example, in one application, solids processing unit 100 may be configured to reduce the size of all drilled solids larger than 3.8 cm (1.5 in) in diameter to an average diameter of 1.2 cm (0.5 in), but not affect any drilled solids smaller than 3.8 cm (1.5 in). Because the solids processing mechanism 120 would be configured to crush pieces larger than 3.8 cm (1.5 in) into much smaller pieces, a technician evaluating samples passing through the SPU 100 may deduce that larger particles passing through the SPU 100 (i.e., those between 12 cm (0.5 in) and 3.8 cm (1.5 in) in size) were not reduced by the solids processing mechanism 120. Thus, through selective sampling, a surface technician may be able to differentiate (at the surface) particles bypassing solids processing mechanism 120 from those reduced by solids processing mechanism 120.

In select embodiments, a control system used with the solids processing unit 100 may vary the cutting speed and torque in order to "cut through" certain materials. For example, a control system may incorporate a blade speed sensor to measure the rotational speed of blades 122, 222 on shafts 126, 226 and a drive torque sensor to measure an output torque supplied to solids processing mechanism 120 by drive mechanism 140. By using the blade speed sensor, solids processing unit 100 may be controlled such that blades 122, 222 of solids processing mechanism 120 are rotated at a selected maximum forward speed (i.e., a maximum forward speed set point) and that a torque output from drive mechanism 140 may be controlled (i.e., increased or decreased) to maintain the selected maximum forward speed.

In the event that drive mechanism 140 cannot provide enough torque to maintain the selected maximum forward speed, then the forward speed may be reduced. In the event that the torque output of the drive mechanism is insufficient to maintain a selected minimum forward speed (i.e., a minimum forward speed set point), the rotation of the blades 122, 222 and solids processing mechanism 120 may be reversed (at a selected reverse speed) by the controller to clean out the solids processing mechanism 120.

Similarly, the torque output of the drive mechanism may be controlled, (i.e., increased or decreased) to maintain the selected reverse speed. After a specified amount of rotation, the control system may stop the reverse rotation and forwardly rotate the solids processing mechanism 120 again at the selected maximum forward speed. In the alternative, the control system may stop the reverse rotation after the solids processing mechanism is reversed for a specified amount time at a drive torque lower than a selected reverse torque limit. Furthermore, if the drive mechanism exceeds a maximum torque in either the forward direction or the reverse direction (indicating a potential jam or malfunction in the solids processing mechanism 120), the control system may be configured to shut down the solids processing unit 100 until the solids processing mechanism can be inspected, manually cleaned, or replaced so that other components of solids processing unit 100 may not be damaged.

As such, the SPU 100 may be operated both in a manual mode and in an automatic mode. Increasing the speed (RPM) of solids processing unit 100 may be accomplished by sending a signal to a hydraulic drive pump to increase the fluid flow rate to the motor driving the solids processing mechanism 120. The RPMs at which shafts 126, 226 of the solids processing mechanism 120 rotate may be sensed by a pulse sensor transmitting the speed to the operator as would be understood by those of ordinary skill in the art.

Solids processing unit 100 may also be programmed to run in an automatic mode.

In select embodiments, control of the solids processing unit 100 may be based on a set of measured pressures termed "high-side" and "low-side" pressures. The pressures may be measured at similar locations for consistency, such as the fluid entry port, fluid discharge port, or any other appropriate location as would be understood by a person skilled in the art. For example, detection of a high-side pressure at the fluid discharge flange may be an indication that the SPU 100 may be rotating in the forward direction, where it may "grip" the drilled solids and process them (i.e., reduce in size). Similarly, presence of a low-side pressure at the discharge port may indicate that the SPU 100 is rotating in the reverse direction, where it may dislodge solids that stick or bind up in the SPU 100.

The sequence of operation of the SPU 100 may be controlled by an algorithm based on several set pressures, or "set points," each of which may be set by an operator. Further, whenever measured high-side or low-side pressures reach particular set points, certain actions may be carried out by the SPU 100, including stopping, reversing, and rotating at selected RPMs. The set points and their operating modes are explained further below.

A Maximum Forward Pressure ("MFP") set point may correspond to a highest allowable developed pressure when the SPU 100 runs in the forward direction. In certain embodiments, this set point allows the SPU 100 to run in the forward direction at about 20 RPM. If the SPU 100 is experiencing any load due to excess drill cuttings or any difficulty in processing solids because of their size, the high-side pressure may increase. When the high-side pressure exceeds the Maximum Forward Pressure, a signal may be sent to stop and/or reverse SPU 100 rotation.

A Reverse Number Of Teeth ("RNOT") set point may be a fraction of a full turn that the SPU 100 will reverse to dislodge stuck solids, the amount of rotation being determined by a specified number of teeth in the drive gear. Therefore, an entry of "24" as the Reverse Number Of Teeth set-point for a drive gear having twenty-four teeth would cause the shafts of the SPU 100 to reverse one complete revolution. As described above, the reverse mechanism incorporated in the control system may act as a safety against large pieces of solids that may be difficult to process in one pass and may possibly overload the system.

A "Maximum Reverse Pressure" ("MRP") set point may be equal to the limiting pressure set point when the SPU 100 runs in the reverse direction. If the low-side pressure increases beyond the Maximum Reverse Pressure set point while reversing, the SPU 100 may be programmed to stop rotating in the reverse direction and/or to start rotating forward again. One purpose of the Maximum Reverse Pressure set point may be to prevent overloading of the SPU 100 in the reverse direction and to prevent the SPU 100 from getting stuck while attempting to dislodge the solids overloading the SPU 100.

A "Maximum Pressure at Low Speed" ("MAXPLS") set point may also be included in an SPU 100 control sequence. As described above, after the SPU 100 reverses a selected number of teeth, the SPU 100 may subsequently rotate forward at a lower speed (e.g., about 8 RPM in select embodiments) and with a higher amount of torque. If, while rotating in the forward direction at the lower speed, the SPU 100 high-side pressure increases above a Maximum Pressure at Low Speed set point, the SPU 100 may stop and rotate in reverse. This control step may be incorporated to protect the components as well as the system from overloading. After changing direction and rotating in reverse, in select embodiments the SPU 100 may repeat the sequence of steps (RNOT, MRP, etc.) described above.

Furthermore, a "Minimum Pressure at Low Speed" ("MINPLS") set point pressure may also be implemented in an SPU 100 control scheme. If after running at low speed for a select amount of time, the high-side pressure has decreased to a value that is below the MINPLS, the SPU 100 may change from the lower speed back to the higher speed (e.g., 20 RPM) and continue rotating in the forward direction. Furthermore, the control system set point would likewise change from MAXPLS back to MFP.

As such, a method to retrieve drilling mud containing entrained solids from a subsea well may include breaking up (i.e., reducing the size of) a portion of the subsea solids at or near the sea floor. From there, the reduced solids may either be disposed of at the sea floor or may be discharged (along with the drilling mud and remaining entrained solids) to a surface facility. The retrieval may also include breaking up the portion of the entrained solids with intermeshed cutters of a solids processing unit. The method to retrieve may also include bypassing entrained solids that are smaller than a specified size around the solids processing unit to an outlet of the solids processing unit. The drilling mud and entrained solids, whether broken-up or bypassed, may be discharged from the outlet and pumped to the surface facility. As used herein, "surface facility" may be any storage, processing, disposal, measurement, recycling, or other facility that is located "above" the location of the subsea well. Therefore, a surface facility may include, but should not be limited to, a floating vessel, a tethered or anchored platform, or a land-based facility.

Advantageously, embodiments disclosed herein may prevent plugging or stoppage of return lines and/or mud lift pump chambers. Because mud is pumped back to the surface using a positive displacement diaphragm pump in dual-gradient drilling operations, it may be beneficial to ensure that there is no plugging of either the lines or the pump chamber below the diaphragm with large solids. Primarily because, in the event of plugging of the line or the pump, it becomes difficult to revert to a single gradient in the well without loss of the well. Therefore, embodiments disclosed herein may greatly reduce costs and drilling time by preventing downhole failures.

Also, those skilled in the art will appreciate that it may be undesirable to allow large pieces of solids to accumulate in the well bore where they may pose a potential threat by way of increased drilling torque, bit drag, tight-pull, hole pack-off, and various other drilling problems that may result. Maintaining large amounts of solids in the annulus may also increase the effective density of the fluid, thereby increasing the effective bottom hole pressure on the formation and thus increasing the risk of fracture. Advantageously, embodiments disclosed herein may help ensure that large solids are not left in the well or allowed to agglomerate and grow. Rather, a solids processing unit in accordance with embodiments disclosed herein (e.g., 100) may be configured to process solids in the mud flow stream.

Further, embodiments disclosed herein may also provide a more environment-friendly solids processing operation. In some dual-gradient drilling applications, drilled solids would otherwise be separated and dumped on the sea floor. Solids processing units in accordance with embodiments disclosed herein are particularly advantageous in view of stringent environmental regulations currently in effect in several parts of the world (e.g., the North Sea and the Gulf of Mexico), thus eliminating or substantially reducing the need to deposit the cuttings on the sea floor, especially when oil-based drilling fluids are used. Instead, the drilled solids may be recovered to the surface, particularly in sizes acceptable for geological study.

Still further, embodiments disclosed herein may allow better geological samples of drill cuttings to be obtained by geologists at the surface. With very small solids, the geological information contained within the cuttings may be compromised. Further, the smaller solids may beneficially affect mud properties such as density, plastic viscosity, and the gel strength, all of which may improve substantially as the size of entrained solids in the returning mud decreases.

Select embodiments disclosed herein work by macroscopically reducing the size of only the larger particles to no greater than a specified dimension. Particles that are smaller than the specified dimension may pass through without being processed. Thus, the integrity of the cuttings is maintained and their sized kept large enough for geological study and analysis without affecting the properties of the mud, but not so large as to clog or impede the fluid flow through the subsea pumping equipment.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A subsea solids processing unit for comminuting cuttings in drilling mud being returned from a well being drilled, comprising:

a housing having a drilling mud inlet and a drilling mud outlet, the housing defining a pressure containing vessel capable of being operated in a subsea environment, the drilling mud inlet adapted to be connected to a subsea drilling mud return flow line;

a solids processing mechanism disposed in the housing between the drilling mud inlet and the drilling mud outlet, the solids processing mechanism comprising:

a first shaft comprising a first plurality of cutters and configured to rotate about a first axis in a first direction;

a second shaft comprising a second plurality of cutters and configured to rotate about a second axis in a second direction, wherein the first plurality of cutters are configured to intermesh with the second plurality of cutters;

a flushing mechanism configured to flush the solids processing mechanism with a flushing fluid;

a lubricant reservoir containing a lubricant for supplying lubricant to portions of the unit;

a pressure intensifier connected with the lubricant reservoir for applying a pressure to the lubricant being supplied to the unit that is responsive to and higher than drilling mud pressure at the drilling mud inlet or drilling mud outlet.

2. The subsea solids processing unit of claim 1, wherein the flushing mechanism comprises at least one nozzle disposed on the housing and flushes the first and second pluralities of cutters of the solids processing mechanism with the flushing fluid; and the flushing mechanism is adapted to be connected to a drilling mud inflow line for flushing the cutters with drilling mud bring pumped into the well.

3. The subsea solids processing unit of claim 1, wherein the flushing mechanism comprises a first row of nozzles disposed adjacent to the first and the second pluralities of cutters.

4. The subsea solids processing unit of claim 1, further comprising: a first plurality of spacers positioned between the first plurality of cutters along the first axis; and a second plurality of spacers positioned between the second plurality of cutters along the second axis.

5. The subsea solids processing unit of claim 1, further comprising:

a controller having an automatic mode wherein the controller controls rotation of the first and second shafts based on a pressure differential between drilling mud pressure at the drilling mud inlet and the drilling mud outlet.

6. The subsea solids processing unit of claim 5, wherein the controller is configured such that while in the automatic mode, a pressure differential exceeds a selected maximum, the controller causes the first and second shafts to reverse rotation.

7. The subsea solids processing unit of claim 6, wherein after the controller is configured such that after the controller has reversed rotation in response to a pressure differential in excess of the selected maximum, the controller causes forward rotation but at a lower speed and higher torque than employed when the pressure differential exceeded the selected maximum.

8. The subsea solids processing unit of claim 1, further comprising:

a controller that automatically varies the speed of rotation of the cutters in response to torque applied to the first and second shafts.

9. The processing unit of claim 1, further comprising:

a controller that automatically reverses rotation of the first and second shafts in the event a minimum forward speed is not attainable.

10. The processing unit of claim 9, wherein the controller automatically returns to forward rotation after a selected period of reverse rotation.

11. A subsea solids processing unit for comminuting cuttings in drilling mud being returned from a well being drilled, comprising:

a housing having a drilling mud inlet and a drilling mud outlet, the housing defining a pressure containing vessel capable of being operated in a subsea environment, the drilling mud inlet adapted to be connected to a subsea drilling mud return flow line;

a solids processing mechanism disposed in the housing between the drilling mud inlet and the drilling mud outlet, the solids processing mechanism comprising:

a first shaft comprising a first plurality of cutters and configured to rotate about a first axis in a first direction;

a second shaft comprising a second plurality of cutters and configured to rotate about a second axis in a second direction, wherein the first plurality of cutters are configured to intermesh with the second plurality of cutters;

a controller that senses rotational conditions of the first and second shafts and varies rotation of the first and the second shafts in response; and wherein the controller has an automatic mode wherein the controller controls rotation of the first and second shafts based on a pressure differential between drilling mud pressure at the drilling mud inlet and the drilling mud outlet.

12. The subsea solids processing unit of claim 11, wherein the controller has a speed sensor that senses the rotational speeds of the first and shafts.

13. The subsea solids processing unit of claim 11, wherein the controller is configured such that while in the automatic mode, a pressure differential exceeds a selected maximum, the controller causes the first and second shafts to reverse rotation.

14. The subsea solids processing unit of claim 13, wherein after the controller is configured such that after the controller has reversed rotation in response to a pressure differential in excess of the selected maximum, the controller causes forward rotation but at a lower speed and higher torque than employed when the pressure differential exceeded the selected maximum.

15. A subsea solids processing unit for comminuting cuttings in drilling mud being returned from a well being drilled, comprising:

a housing having first and second drilling mud ports, the housing defining a pressure containing vessel capable of being operated in a subsea environment, the first drilling mud port adapted to be connected to a subsea drilling mud return flow line for receiving drilling mud flowing from the well, and the second drilling mud port adapted to be connected to a subsea pumping unit for delivering the drilling mud flowing from the housing to the subsea pumping unit;

a solids processing mechanism disposed in the housing between the first and second drilling mud ports, the solids processing mechanism comprising:

a first shaft comprising a first plurality of cutters and configured to rotate about a first axis in a first direction;

a second shaft comprising a second plurality of cutters and configured to rotate about a second axis in a second direction, wherein the first plurality of cutters are configured to intermesh with the second plurality of cutters;

a drive motor;

a gear mechanism operatively coupled between the first and second shafts and the drive motor for causing rotation of the first and second shafts;

a lubricant reservoir containing a lubricant for supplying lubricant to the gear mechanism;

a pressure intensifier having at least one piston located within a cylinder;

an input line communicating fluid pressure of the drilling mud in one of the first and second drilling mud ports to the pressure intensifier, which produces a fluid output pressure proportional to but greater than the fluid pressure of the drilling mud in one of the first and second drilling mud ports; and an output line leading from the pressure intensifier to the lubricant reservoir connected with the lubricant reservoir for applying the output fluid pressure to the lubricant being supplied to the unit.

16. The subsea solids processing unit of claim 15, further comprising an isolator in the input line that isolates drilling mud from lubricant contained in the lubricant reservoir.

17. The subsea solids processing unit of claim 15, wherein said at least one piston comprises two pistons, one having a diameter larger than the other.

* * * * *